US008898872B2

(12) United States Patent
Raymond

(10) Patent No.: US 8,898,872 B2
(45) Date of Patent: Dec. 2, 2014

(54) SPACE-CREATING SHOWER CURTAIN HOOK

(71) Applicant: Patrick Raymond, New York, NY (US)

(72) Inventor: Patrick Raymond, New York, NY (US)

( * ) Notice: Subject to any disclaimer, the term of this patent is extended or adjusted under 35 U.S.C. 154(b) by 224 days.

(21) Appl. No.: 13/623,835

(22) Filed: Sep. 20, 2012

(65) Prior Publication Data

US 2013/0067704 A1 Mar. 21, 2013

Related U.S. Application Data

(60) Provisional application No. 61/537,464, filed on Sep. 21, 2011.

(51) Int. Cl.
*A47H 13/04* (2006.01)
*A47K 3/38* (2006.01)

(52) U.S. Cl.
CPC ..... *A47K 3/38* (2013.01)
USPC ..... 24/716; 4/558; 4/610

(58) Field of Classification Search
CPC ..... A47G 25/32; A47G 25/34; A47H 1/00; A47H 1/02; A47H 13/04; A47H 13/16; A47H 13/00; A47H 2001/00; A47H 2001/02; A47K 3/38
USPC ..... 24/716, 370, 372, 373; 248/215, 214, 248/314, 252, 256, 257, 259, 339, 340; 4/610, 558; 160/330, 368.1, 105, 351; 211/105.1–105.6, 106.01, 123, 124
See application file for complete search history.

(56) References Cited

U.S. PATENT DOCUMENTS

| | | | | |
|---|---|---|---|---|
| 2,188,163 | A | 1/1940 | Sherman | |
| 2,936,076 | A | 5/1960 | Harris | |
| 3,140,557 | A | 7/1964 | Albrycht | |
| 3,382,507 | A | 5/1968 | Micheau | |
| 3,872,520 | A | 3/1975 | Tyconik et al. | |
| 5,007,120 | A * | 4/1991 | Annand | 4/558 |
| 5,097,120 | A | 3/1992 | Kitamura et al. | |
| 5,097,541 | A | 3/1992 | Annand et al. | |
| 5,103,531 | A | 4/1992 | Perrotta | |
| 5,201,081 | A | 4/1993 | Knight | |
| 5,345,623 | A | 9/1994 | Dearman | |
| 5,345,624 | A | 9/1994 | Brown, III | |
| 5,771,504 | A | 6/1998 | Steiner | |
| 5,809,589 | A | 9/1998 | Johnson | |
| 6,032,306 | A | 3/2000 | Gummin | |
| 6,041,454 | A | 3/2000 | Summerford | |
| 6,550,525 | B1 | 4/2003 | Grisolia | |
| 6,591,432 | B1 | 7/2003 | Feinstein et al. | |
| 6,996,862 | B1 | 2/2006 | Shippy et al. | |
| 7,748,673 | B2 * | 7/2010 | Barrese | 248/215 |
| 2002/0108724 | A1 | 8/2002 | Grahn | |
| 2006/0085904 | A1 * | 4/2006 | Tsvok | 4/558 |
| 2006/0085905 | A1 | 4/2006 | Raymond | |
| 2006/0272087 | A1 | 12/2006 | Raymond | |
| 2007/0050904 | A1 * | 3/2007 | Harwanko | 4/558 |

OTHER PUBLICATIONS

Curtain Bouncer—The Shower Curtain Effect Solution; Available: http://www.curtainbouncer.com/index.html; retrieved on: Jun. 27, 2014.

* cited by examiner

*Primary Examiner* — Robert J Sandy
*Assistant Examiner* — Abigail Morrell
(74) *Attorney, Agent, or Firm* — Troutman Sanders LLP

(57) ABSTRACT

A space-creating shower curtain hook hanging from a shower curtain rod. It includes a shower rod hook engaging the shower curtain rod; a neck disposed upwards and inwards from the shower rod hook; a first connector disposed along the neck engaging a shower liner; and a stem connected to the neck and disposed downwards. The weight of the shower liner causes the space-creating shower curtain hook to rotate about the shower curtain rod, contacting the stem to the shower liner, and disposing the shower liner outwards of the shower curtain rod.

4 Claims, 4 Drawing Sheets

Fig. 2
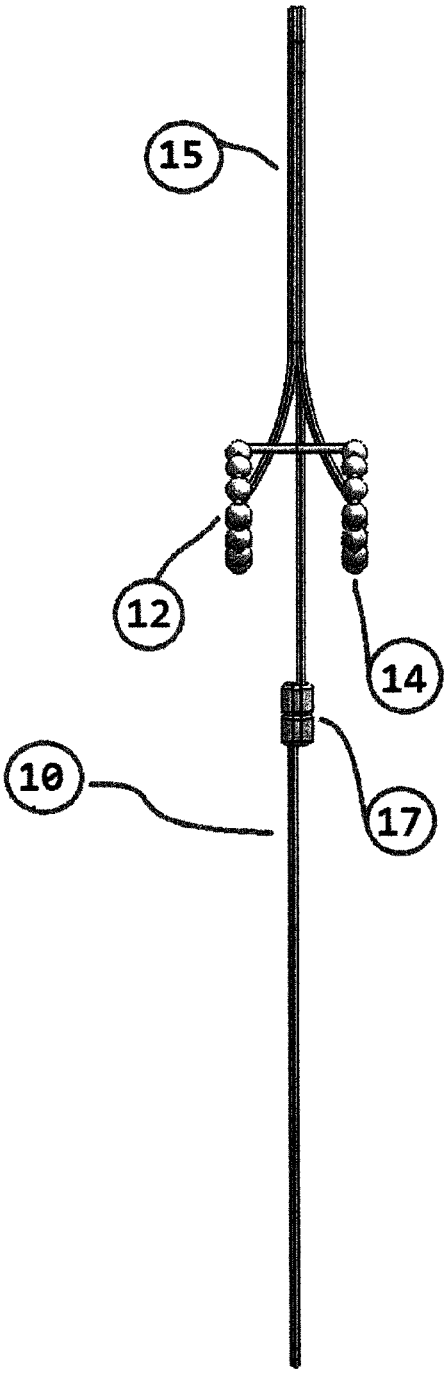
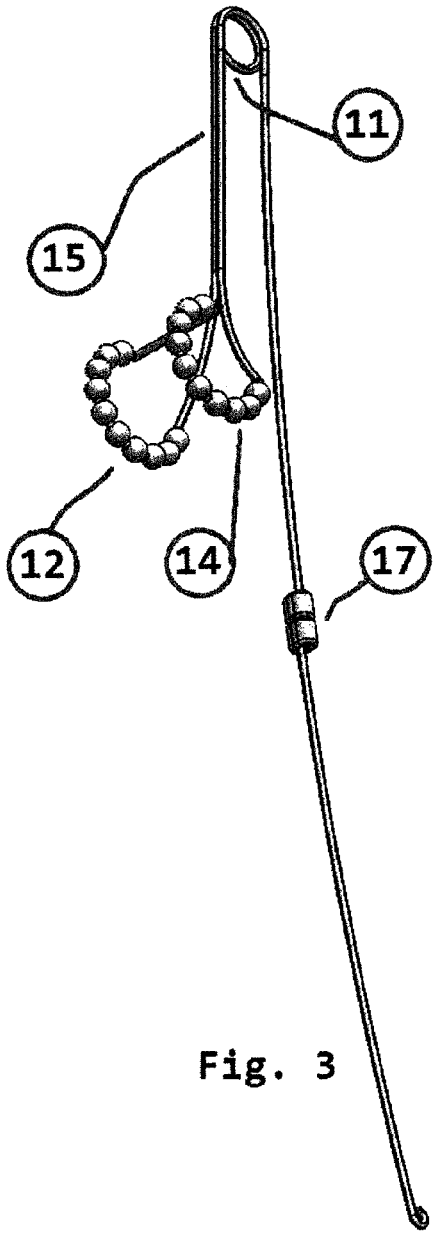
Fig. 3

SPACE-CREATING SHOWER CURTAIN HOOK

CROSS-REFERENCE TO RELATED APPLICATION

This application claims priority to U.S. Provisional Application Ser. No. 61/537,464 filed Sep. 21, 2011. The provisional application is incorporated herein in its entirety.

FIELD OF THE INVENTION

This invention relates to a device for holding the shower curtain away from the body of a person taking a shower.

BACKGROUND OF THE INVENTION

When showers are taken in bathtubs, shower curtains are often used to retain the water within the confines of the bathtub. Typically, a shower curtain has up to 12 grommet holes at the top, and it hangs from a set of up to 12 hooks that each engage with a grommet hole, and collectively to a curtain rod located above the shower head. Because of the flow of water and air while showering, the shower curtain tends to swell inwardly, sometimes clinging to the body of the person taking the shower, which most people find unpleasant. The present invention provides a space-creating shower curtain hook for retaining a shower curtain away from the person's body during a shower.

BRIEF DESCRIPTION OF THE DRAWINGS

The examples of the present invention are described with reference to the attached drawings in which:

FIG. 2 is a front elevation view of the space-creating shower curtain hook;

FIG. 3 is a perspective view of the space-creating shower curtain hook;

DETAILED DESCRIPTION

Figure 1:
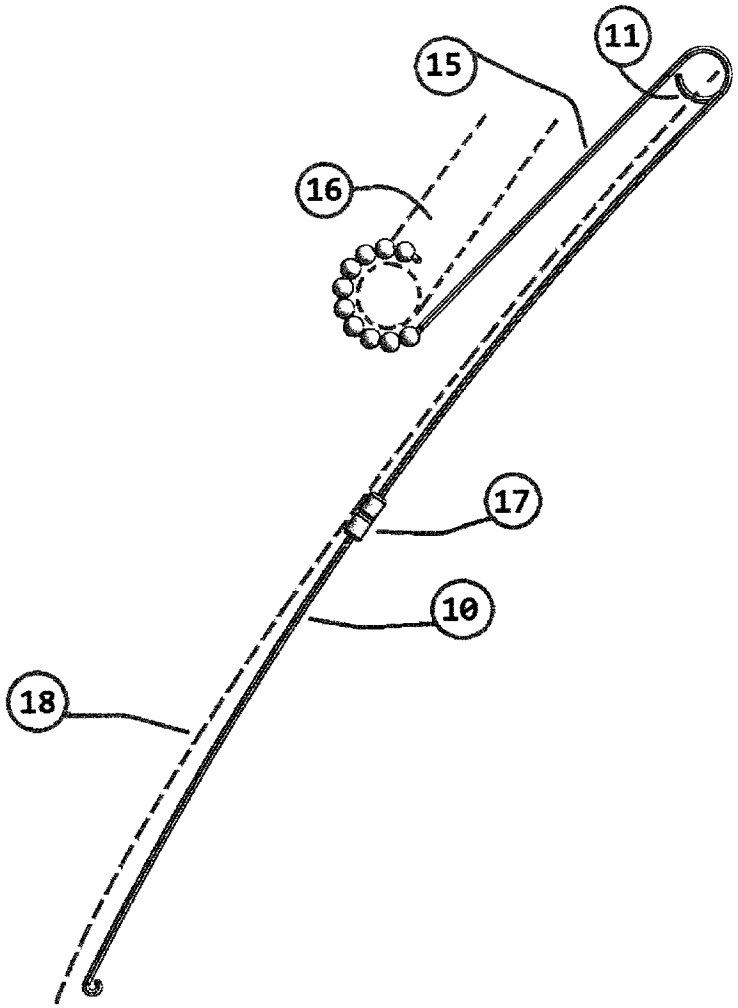
FIG. 1 is a side elevation view of the space-creating shower curtain hook.

Referring to FIGS. 1 and 2, a space-creating shower curtain hook, in accordance with an example of the invention, can be made of any suitable material such as metal or plastic. A standard shower curtain arrangement is shown in phantom lines in FIG. 1. The shower curtain rod on which the curtain is hung is shown at 16 and the curtain itself at 18. As is conventional, a multiplicity (up to 12) hooks retain shower curtain 18 on the rod 16.

The effect of the space-creating shower curtain hook prevents the shower curtain from swelling inwardly toward the person's body when the shower is turned on. The space-creating shower curtain hook has a pair of spaced apart hooks 12 and 14 which engage onto the shower curtain rod 16. The hooks 12 and 14 connect to a neck 15 that acts as a lever with shower curtain rod 16 as its fulcrum. The neck 15 includes a connector 11 which is located at or near the end of the neck

15. The neck 15 is connected (through the connector 11) to a stem 10, which is longer than the neck 15. One of the grommet holes of the shower curtain 18 engages with the space-creating shower curtain hook at its connector 11. Since the connector 11 is a distance away from the shower curtain rod 16, the natural weight of the shower curtain 18, when engaged with connector 11, levers the neck 15 downward, and in so doing, forces the stem 10 to push against the shower curtain 18 and thus, away from the body of the person taking a shower.

The neck 15 and the connector 11 project inwards and upwards toward an interior of the shower and above a head of the user. Thus, the stem 10 is hidden from outside the shower by the shower curtain. In an example, the neck 15 and stem 10 can be designed as such so the base of the curtain 18 does not fall outside the wall of the shower/tub when used with shower/bath tub combination. In another example, a second connector can project from the base of the neck 10 and toward the outside of the shower. The second connector can be used to hang a second curtain in front of the curtain 18. The second connector can be placed approximate to connector 11 or disposed down the neck, nearer to the hooks 12, 14. This can space the typically heaver second curtain away from the curtain 18, so as to not apply its weight to the curtain 18 and "tip" the space-creating shower curtain hook back.

Figures 4, 5, 6:
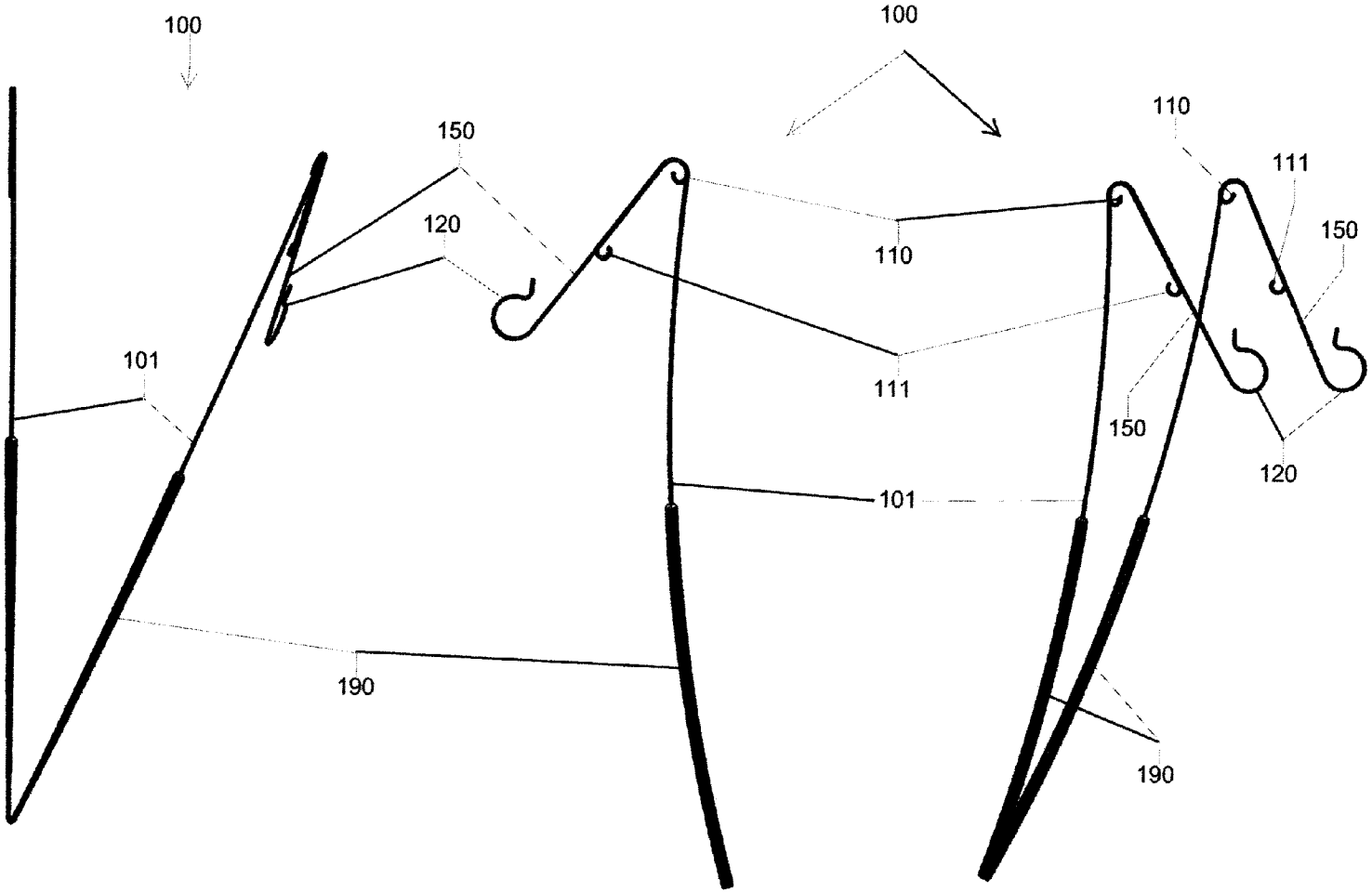
FIG. 4 is a front elevation view of another example of the space-creating shower curtain hook.
FIG. 5 is a side elevation view of the other example of the space-creating shower curtain hook.
FIG. 6 is a perspective view of the other example of the space-creating shower curtain hook.

An example of a two connector space-creating shower curtain hook is illustrated in FIGS. 4-6. As shown, a space-creating shower curtain hook 100 includes shower rod hooks 120 that engage the shower rod. The rod hooks 120 extend into a neck 150 that can project higher than the shower rod and rod hooks 120. The neck 15 also extends somewhat inward of the shower curtain rod, i.e., into the shower area. The neck 150 can have a first connector 110 and a second connector 111. The first connector 110 can engage the inner shower curtain, also called a liner, at one of the liner's grommet holes. The typically decorative outer shower curtain engages the second connector 111 at one of its grommet holes.

Extending past the neck 150 is the stem 101 which is directed downwards toward the floor of the shower, and in this example, extends past the shower rod and rod hooks 120. Multiple space-creating shower curtain hooks 100 can be joined at the stems 101 by numerous methods. Multiple hooks 100 can be joined by physically joining the bottom of the stems 101 with adhesive or welding. Two hooks 100 can be formed at the opposite ends of a single length of material and bent at the proper location. Further, two hooks 100 can be permanently or non-permanently joined with a joiner 190. In one example, the joiner 190 is a flexible piece of hollow tubing that can engage the stems 101 and bend so both rod hooks 120 can engage the shower rod.

As above, since the first connector 110 is a distance away from the shower curtain rod, the natural weight of the liner, when engaged with connector 110, levers the neck 150 downward, and in so doing, forces the stem 101 to push against the liner and thus, away from the body of the person taking a shower. The second connector 111 can be disposed lower on the neck 150, thus closer to the shower rod, than the first connector 110. This puts the outer shower curtain closer to the shower rod and provides some, but less, force than the liner, because of the length of the fulcrum arm. Put simply, the torque generated around the shower rod to push out the liner is based on the mass of the liner/outer curtain and its distance from the shower rod.

Figure 7:
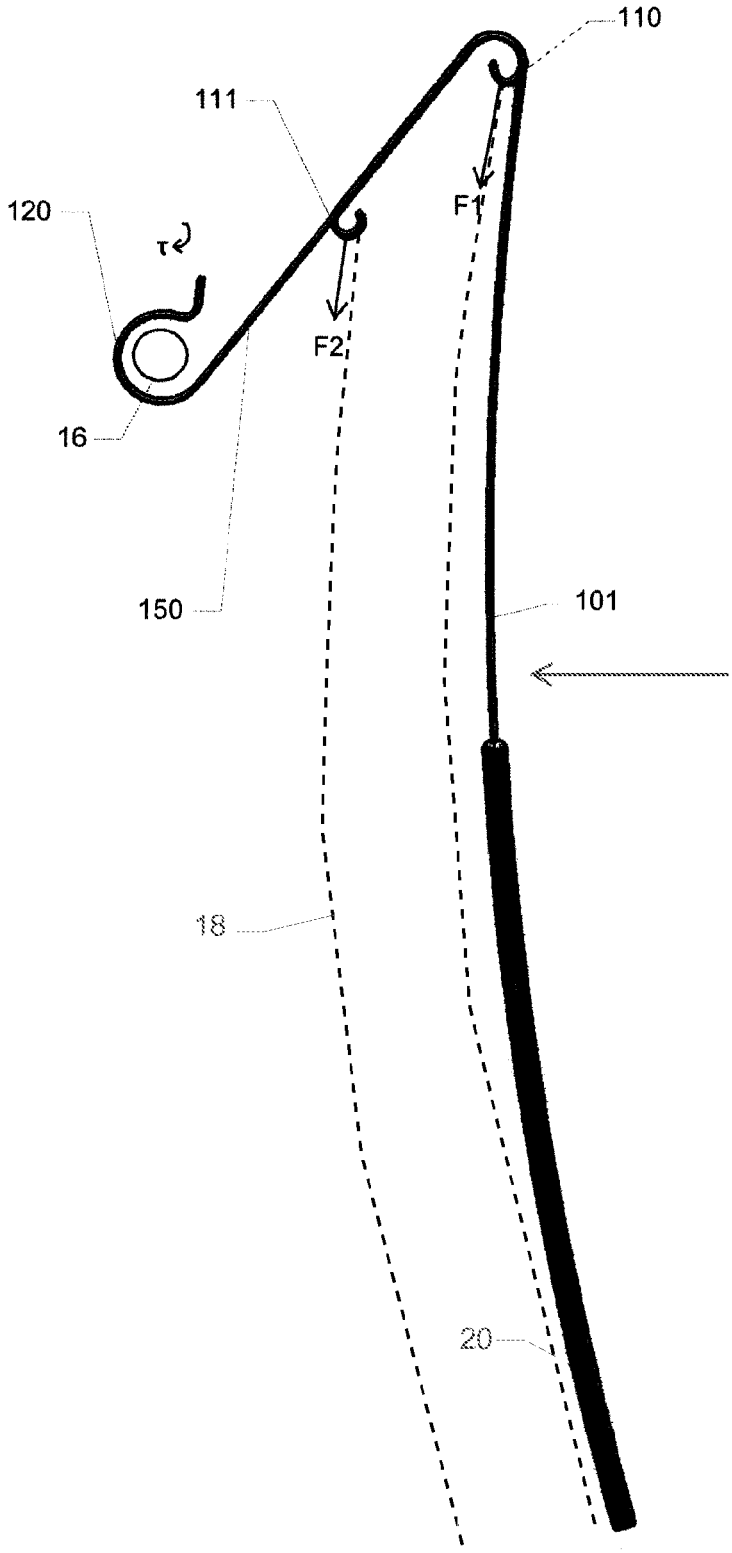
FIG. 7 is a force diagram of the space-creating shower curtain hook.

The forces can be seen in FIG. 7. As illustrated, the rod hooks 120 can rotate around shower curtain rod 16, which acts as a pivot or fulcrum point. The arm is the neck 150 and the distance from the shower curtain rod 16 to each of the first and second connectors 110, 111 defines the length over which the force acts. A first force F1 is created by the weight of a liner 20 pulling down on the first connector 110 and second force F2 is created by the weight of the shower curtain 18. These forces F1, F2 create a torque τ, which in FIG. 7 acts clockwise and moves the stem 101 to the left of the page pushing the liner 20 and curtain 18 outward, toward the left, as well.

It is contemplated that the space-creating shower curtain hook will be approximately 2" wide and 18" long although obviously the dimensions are not a part of the invention. For packaging and storage purposes, the space-creating shower curtain hook may be sold as separate parts in the form of a kit which can be assembled by the user after purchase. The stem 10 of the space-creating shower curtain hook may also be removable and/or retractable using a stem joint 17. It might also vary in length so as to provide customized utility.

Further, the hooks 12, 14, 120 can be closed, as to be slid on the shower rod before installation or open to allow for removability. Also, the hooks 12, 14, 120 can be beaded, coated, or plain, to allow for ease of movement along the shower rod.

While there are descriptions of examples as set forth above, the descriptions and drawings that form a portion of the disclosure are not to be understood to limit the present invention. A variety of alternate examples and operating technologies should be obvious to those skilled in the art.

What is claimed is:

1. A space-creating shower curtain hook hanging from a shower curtain rod, comprising:

a shower rod hook engaging the shower curtain rod;

a neck disposed upwards and inwards from the shower rod hook;

a first connector disposed along the neck engaging a shower liner; and a stem connected to the neck and disposed downwards;

wherein a weight of the shower liner causes the space-creating shower curtain hook to rotate about the shower curtain rod, contacting the stem to the shower liner, and disposing the shower liner outwards of the shower curtain rod.

2. The space-creating shower curtain hook of claim 1, further comprising:

a second connector disposed along the neck and closer to the shower curtain rod than the first connector, wherein the second connector engages a shower curtain.

3. The space-creating shower curtain hook of claim 1, further comprising:

a stem joint disposed along the stem to at least one of retract or remove a base of the stem.

4. The space-creating shower curtain hook of claim 1, further comprising:

a joiner to join the stem of the space-creating shower curtain hook to a second stem of another space-creating shower curtain hook.

* * * * *